US005364133A

United States Patent [19]

Hofer et al.

[11] Patent Number: 5,364,133

[45] Date of Patent: Nov. 15, 1994

[54] IDENTIFICATION BRACELET

[75] Inventors: Gene A. Hofer, Lake Zurich; Karen M. Longe, Chicago, both of Ill.

[73] Assignee: Zebra Technologies Corporation, Vernon Hills, Ill.

[21] Appl. No.: 180,440

[22] Filed: Jan. 12, 1994

[51] Int. Cl.[5] ..... B42D 15/00

[52] U.S. Cl. ..... 283/75; 283/900; 283/94; 40/633

[58] Field of Search ..... 283/72, 74, 75, 80, 283/94, 98, 107, 900; 40/633, 299, 304, 665

[56] References Cited

U.S. PATENT DOCUMENTS

| | | | |
|---|---|---|---|
| 4,154,011 | 5/1979 | Rakestran et al. | 283/75 X |
| 4,311,740 | 1/1982 | Kay | 427/428 |
| 4,314,415 | 2/1982 | De Woskin | 40/633 |
| 4,377,047 | 3/1983 | Adams, Jr. et al. | 40/633 |
| 4,386,795 | 6/1983 | Charles et al. | 283/75 |
| 4,783,917 | 11/1988 | Smith et al. | 40/633 |
| 4,914,843 | 4/1990 | De Woskin | 283/75 X |
| 4,991,337 | 2/1991 | Solon | 40/633 |
| 5,006,830 | 4/1991 | Merritt | 283/75 X |

*Primary Examiner*—Mark Rosenbaum
*Assistant Examiner*—Willmon Fridie, Jr.
*Attorney, Agent, or Firm*—Trexler, Bushnell, Giangiorgi & Blackstone, Ltd.

[57] ABSTRACT

An identification bracelet formed from upper and lower layers of flexible material removably laminated with a selectively printed release layer and a pigmented adhesive. The lower layer has a plurality of die cut areas which can be removed to expose a portion of the adhesive, which is then overlapped with, and attached to the upper layer. The adhesive is applied over a selectively printed release layer so as to have areas of high adhesion and areas of low adhesion to the upper layer which separate differentially and form a "void" indication, for example, if the attached ends are separated after application.

17 Claims, 5 Drawing Sheets

IDENTIFICATION BRACELET

BACKGROUND OF THE INVENTION a. Field of the Invention

This invention relates to an identification bracelet, and more specifically to a bracelet incorporating a security feature which will render it visibly invalid if tampered with.

b. Description of Related Prior Art

It is the customary practice in hospitals to identify patients for various purposes with bracelets or bands incorporating a patient name, a patient number or other identifying information. One purpose for such identifying information is to check the patient's identity before treatment to confirm that the appropriate treatment is being given as ordered. It is critically important to these institutions that the patient identification bracelet be secure and that any unauthorized removal or attempted interchange of bracelets between patients be easily detected.

Similar techniques can be used for patron identification at concerts, amusement parks, ski lifts, or other ticketing applications. Although unauthorized removal or interchange in these applications may not necessarily be life threatening, detection can still play a very important security role.

OBJECTS AND SUMMARY OF THE INVENTION

A general objective of the present invention is to provide an improved identification bracelet which can be indelibly marked and fastened to an individual in such a way that accidental removal is unlikely, and intentional removal and/or reclosure are easily detected.

An identification bracelet having features of the present invention comprises an upper layer of transparent flexible material for displaying data, the upper layer having a top and a bottom surface opposed to one another, a transparent release layer including predetermined printed portions applied to the bottom surface of the upper layer, a pigmented, adhesive layer applied to the bottom surface of the upper layer on top of the release layer, the adhesive layer having a relatively strong adhesive bond to the upper layer in areas between the printed portions, and a relatively weak adhesive bond to the printed portions, so that an attempt to separate the upper layer from the adhesive layer will cause a first portion of the adhesive layer located between the printed portions to remain with the bottom surface of the upper layer, and a second portion of the adhesive layer to separate therefrom, the first portion of the adhesive remaining with the upper layer thereby forming a pigmented border around the printed portions, and thus making the printed portions visually distinguishable from the upper layer and providing an indication that the identification bracelet has been tampered with, such as by revealing the word "void".

Other objects and advantages of the invention will become apparent upon reading the following detailed description, and upon reference to the drawings. Throughout the description, like reference numerals refer to like parts.

BRIEF DESCRIPTION OF THE DRAWINGS

The features of the present invention which are believed to be novel are set forth with particularity in the appended claims. The organization and manner of operation of the invention together with further objects and advantages thereof may best be understood by reference to the following descriptions taken in connection with the accompanying drawings, in which:

DETAILED DESCRIPTION OF THE PREFERRED EMBODIMENT

While the invention will be described in connection with a preferred embodiment, it will be understood that it is not intended to limit the invention to that embodiment. On the contrary, it is intended to cover all alternatives, modifications or equivalents as may be included within the spirit and scope of the invention.

Figure 1:
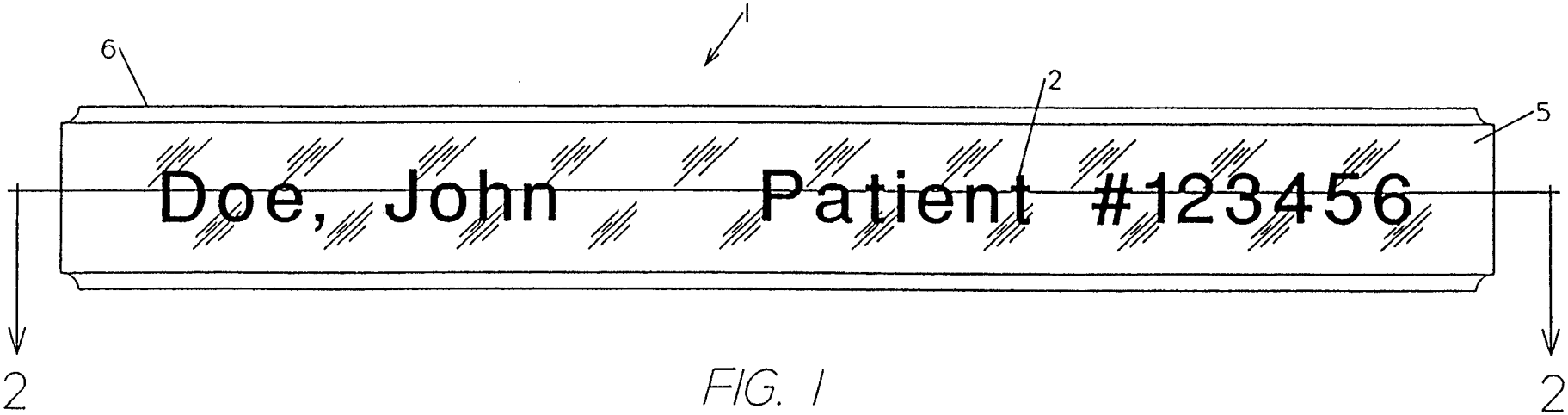
FIG. 1 is an view of the preferred embodiment of the invention illustrating an example of identifying information displayed thereon.

FIG. 1 illustrates a preferred embodiment of an identification bracelet 1. As shown therein, the bracelet 1 bears identifying data 2, such as the name of a hospital patient, a patient number, etc. The data 2 can be applied to the bracelet 1 in numerous ways, such as with thermal transfer printing mechanism, and the bracelet 1 can be formed individually, or in a continuous web, as is further discussed below.

Figure 2:
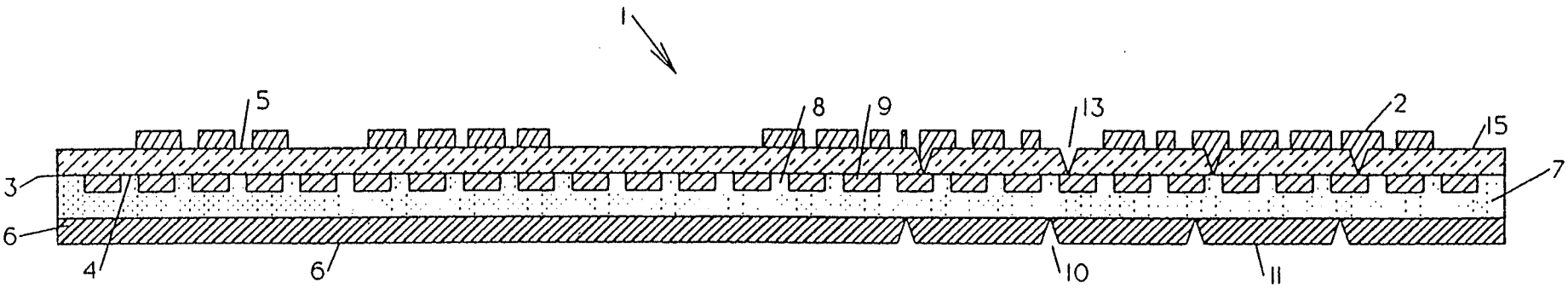
FIG. 2 is a sectional view taken along line 21'2 of FIG. 1 with the dimensions of the component layers of the bracelet exaggerated with respect to thickness and proportion for clarity.

Now referring primarily to FIG. 2, it can be seen that the bracelet 1 is formed of an upper layer 5 of thin, flexible material, typically polyester, which is removably laminated to a lower layer 6 also formed of a flexible material, which may also be of polyester, but is preferably polyethylene or polypropylene. As is known, polyester is a stronger material, but also tends to have sharper edges which in some applications may cause discomfort to the wearer of the bracelet 1. Accordingly, a softer material, such as polyethylene or polypropylene, which has sufficient strength characteristics, is the preferred choice for the lower layer 6 which normally would come into contact with the user's skin. Lamination of the upper layer 5 and the lower layer 6 is accomplished with a pressuresensitive adhesive layer 7. Again, however, it should be noted that a variety of adhesive materials can be utilized to accomplish the same result.

The adhesive layer 7 is applied to the upper layer 5 over a release layer 8 which is selectively printed on the bottom surface 3 of the upper layer 5 so as to selectively disrupt the adhesion of adhesive layer 7 to the upper layer 5 in individual print areas 9, as shown. Adhesive layer 7 is chosen to have a high adhesion to upper layer 5 in non-print areas 4, and relatively low adhesion to the individual print areas 9 for reasons which will be thoroughly discussed below.

As shown best in FIG. 1, the upper layer 5 is preferably formed from a transparent material, as are the print areas 9 which are applied to the bottom surface 3 thereof, which are thus substantially indistinguishable to the human eye when the bracelet 1 is assembled. Further, in the illustrated embodiment, the adhesive layer 7 is pigmented, white, for example. It should also be noted in this regard, that the release layer 8 is significantly thinner than the upper layer 5, which adds to the visual indistinguishability between these layers. As noted earlier, however, in order to improve the clarity and understanding of other features of the invention, the relative thicknesses between these layers is shown out of proportion in the drawings.

With reference again to FIG. 2, lower layer 6, which may or may not be transparent, is die cut at one or more locations 10, thereby forming one or more removable sections 11 of lower layer 6. Upper layer 5 can also be die cut at one or more locations 13 offset from locations 10 such that the unused end of bracelet 1 may be pulled away, and disposed of after application to the wearer. Accordingly, the bracelet 1 can be designed to accommodate a wide range of sizes and applications.

Figure 3:
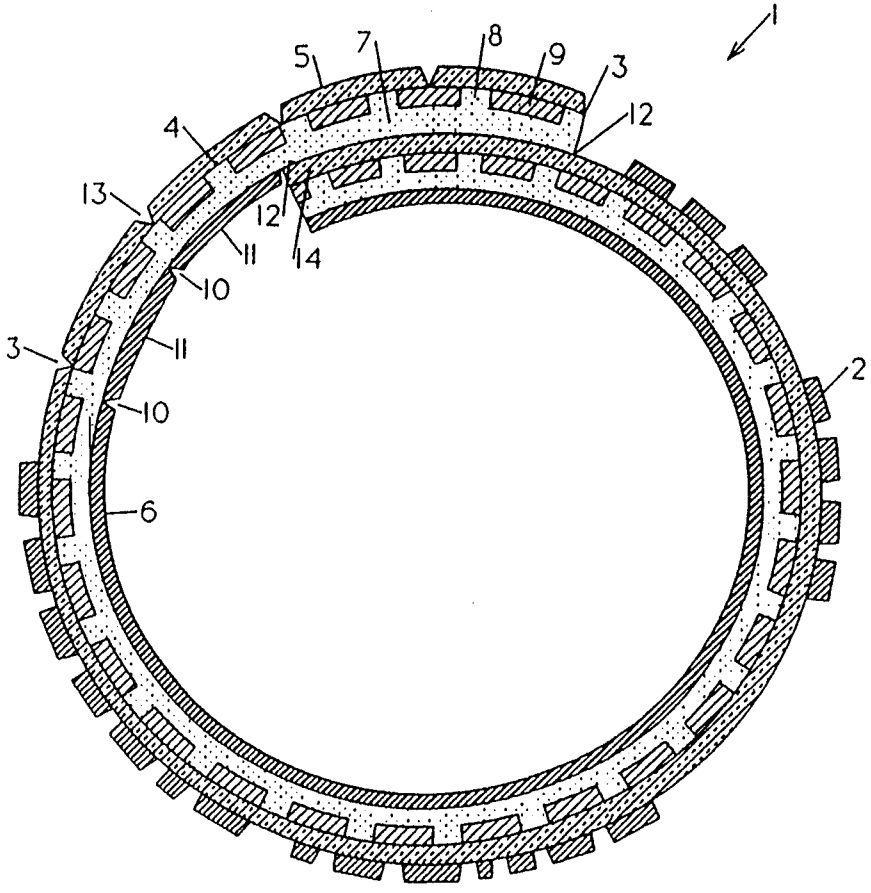
FIG. 3 is a sectional view similar to FIG. 2 illustrating the identification bracelet of the present invention wrapped-around and adhered to itself.

In accordance with one of the main features of the present invention, and with reference initially to FIG. 3, to apply the bracelet 1, one or more of the removable sections 11 are removed and a receiving section 12 of the adhesive layer 7 is thus exposed. It should be noted here that in the preferred embodiment of the invention, the adhesive bond between the lower layer 6 and the adhesive layer 7 should be weaker than the adhesive bond between the adhesive layer 7 and the upper layer 5, both at the non-print areas 4, and the print areas 9, so that these adhesive bonds are not disrupted when the removable sections 11 are peeled-away. The weaker bond between the lower layer 6 and the adhesive layer 7 can be achieved by choice of material for the lower layer 6, or by applying an appropriate coating (not shown) to the lower layer 6. After removal of section(s) 11, a forward end 14 of a top surface 15 of the upper layer 5 can then be rotated around a wearer's wrist, for example, and secured to the receiving section 12.

Figure 4:
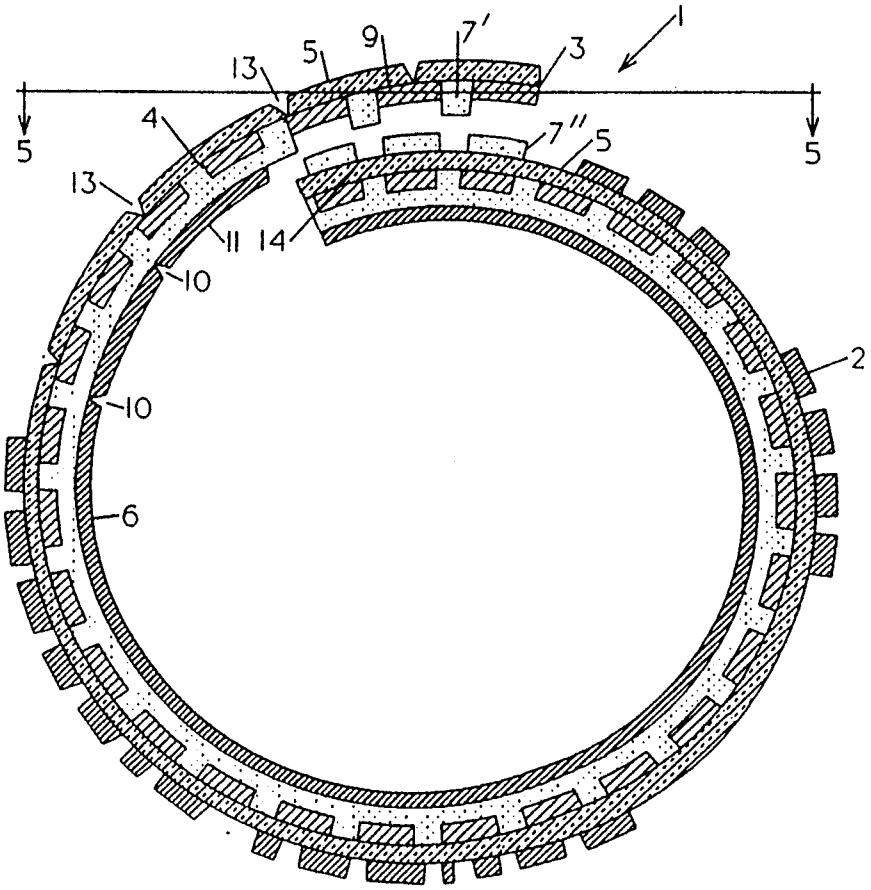
FIG. 4 is a sectional view, similar to FIGS. 2 and 3, showing the adhesive bond of FIG. 3 separated.
Figure 5:
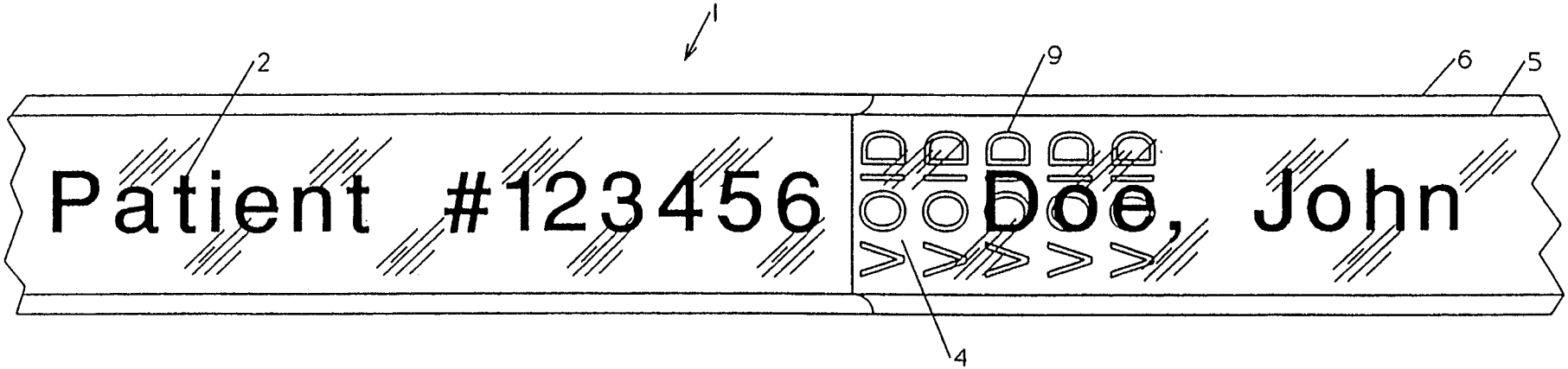
FIG. 5 is a sectional view along line 5—5 of FIG. 4 illustrating the broken adhesive bond and the exemplary "void" phrase which is revealed upon separation.

With reference to FIGS. 4 and 5, it should become apparent that if an attempt is now made to separate the upper layer 5 of the bracelet 1, the adhesive layer 7 will break up into a first portion 7', which remains adhered to the bottom surface 3 of the upper layer 5, and a second portion 7'' which detaches therefrom. The first portion 7' which adheres at non-print areas 4 forms a border around the printed areas 9 and leaves the word "VOID", for example, clearly visible. If an attempt is made to resecure the forward end 14 of the bracelet 1, a misalignment of the adhesive layer 7 will result thereby preserving the visibility of the print areas 9.

It should also be obvious that the invalidity indication ("VOID", for example) may equivalently be formed by the non-print areas 4 outside the print areas 9, or on the carrier of the second portion 7'' which breaks-away from the upper layer 5, and such structure is intended to lie within the scope of the claims. In FIG. 4, the carrier for the second portion 7'' is formed by the forward end 14 of the top surface 15 of the upper layer 5.

Figure 6:
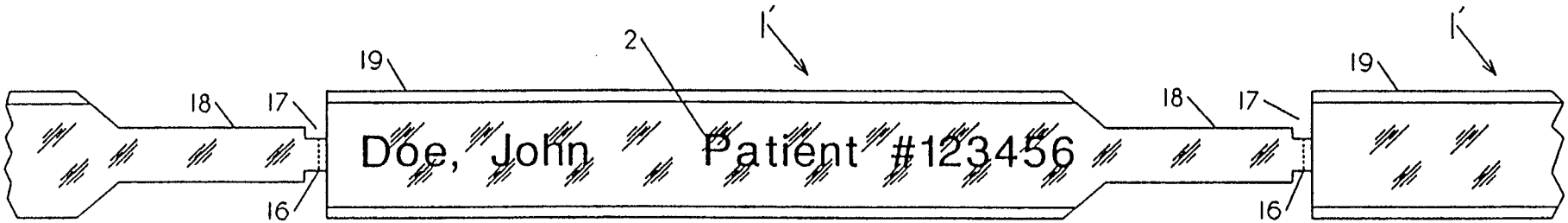
FIG. 6 is a plan view of an alternate embodiment.

FIG. 6 illustrates an alternate embodiment in which bracelets 1' are formed in a continuous web and are separated by a plurality of perforations 16 and notches 17. The notches 17 are of sufficient depth to be sensed by an optical sensing device (not shown), and the continuous web is suitable for feeding into and marking by a thermal transfer printing mechanism. Bracelets 1' are attached as previously described for the preferred embodiment, except that a tapered leading end 18 is further provided in the alternative embodiment which is applied over a non-tapered trailing end 19 when fastened to a wearer. This ensures that no portion of the adhesive exposed in the attachment process will contact the wearer.

The present invention may be embodied in other specific forms without departing from its spirit or essential attributes, and accordingly reference should be made to the appended claims rather than the foregoing specification as indicating the scope of the invention.

The invention is claimed as follows:

1. An identification bracelet comprising:

a. an upper layer of transparent flexible material for displaying identifying data, said upper layer having top and bottom opposed surfaces;

b. a transparent release layer comprising predetermined printed portions applied to said bottom surface of said upper layer;

c. a pigmented, adhesive layer applied to said bottom surface of said upper layer over said release layer, the adhesive layer forming a relatively strong adhesive bond to the upper layer in areas between the printed portions of the release layer, and forming a relatively weak adhesive bond to the printed portions themselves; and, d. a lower layer of flexible material removably laminated to the upper layer by the adhesive layer;

e. wherein, upon any separation of said upper layer from said adhesive layer, a first portion of said pigmented adhesive layer located between said predetermined printed portions of said release layer remains adhered to said bottom surface of said upper layer and forms a border surrounding said printed portions, and a second portion of said adhesive layer detaches therefrom, thereby causing said predetermined printed portions of said release layer to become visually distinguishable from said upper layer and thus providing an indication that the identification bracelet has been altered.

2. An identification bracelet as recited in claim 1, wherein relamination of said upper, release and adhesive layers creates a misalignment between said first and second portions of said adhesive layer and maintains a significant part of the visual distinctiveness of said predetermined printed portions of said release layer.

3. An identification bracelet as recited in claim 1, wherein said lower layer forms a bond with said adhesive layer which is weaker than the bond between said upper layer and said adhesive layer, both at the areas between the printed portions and at the printed portions.

4. An identification bracelet as recited in claim 3, wherein said lower layer is provided with at least one removable section for exposing a section of said adhesive layer and for defining an area for attaching a forward end of said top surface of said upper layer to said exposed adhesive after said identification bracelet has been wrapped around a user, thereby substituting the top surface of the upper layer as a carrier for said adhesive layer at said removable section of said lower layer.

5. An identification bracelet as recited in claim 1, wherein said release layer is substantially thinner than said upper layer of flexible material.

6. An identification bracelet as recited in claim 1, wherein said adhesive layer is formed of a pressure-sensitive adhesive.

7. An identification bracelet as recited in claim 1, wherein said identifying data has been applied to said top surface of said upper layer by a thermal transfer process.

8. An identification bracelet as recited in claim 1, wherein said bracelet has a leading end and a trailing end, and at least one of said ends is tapered as compared to the other.

9. An identification bracelet as recited in claim 1, wherein said lower layer is transparent.

10. An identification bracelet comprising:

a. an upper layer of transparent flexible material for displaying identifying data, said upper layer having top and bottom opposed surfaces;

b. a transparent release layer comprising predetermined printed portions applied to said bottom surface of said upper layer;

c. a pigmented, adhesive layer applied to said bottom surface of said upper layer over said release layer, the adhesive layer having a relatively strong adhesive bond to the upper layer in areas between said printed portions, and a relatively weak adhesive bond in areas where the printed portions exist; and, d. a lower layer of flexible material removably laminated to the upper layer by the adhesive layer;

e. wherein any separation of said upper layer from said adhesive layer causes an image of said predetermined printed portions to be visually defined on the lower layer by a portion of the adhesive layer which remains on the lower layer after separation, thereby providing an indication that the identification bracelet has been altered.

11. An identification bracelet as recited in claim 10, wherein relamination of said upper, release, adhesive and lower layers creates a misalignment in said adhesive layer which preserves a significant part of the visual distinctiveness of said image defined on said lower layer.

12. An identification bracelet as recited in claim 10, wherein said lower layer is provided with at least one removable section for exposing a receiving section of the adhesive layer without otherwise disrupting said adhesive layer, and wherein a forward end of said top surface of said upper layer is attached to said receiving section, thereby replacing said lower layer below said receiving section.

13. An identification bracelet as recited in claim 12, wherein said image of said printed portions is defined by a portion of adhesive remaining on said forward end of said top surface of said upper layer after separation of said upper layer from said adhesive layer.

14. An identification bracelet as recited in claim 10, wherein said release layer is substantially thinner than said upper layer of flexible material.

15. An identification bracelet as recited in claim 10, wherein said identifying data has been printed on said top surface of said upper layer by a thermal transfer process.

16. A continuous series of individual, detachable identification bracelets of the type worn by hospital patients for displaying patient identifying information, each of said individual bracelets comprising:

a. an upper layer of transparent flexible material for displaying identifying data, said upper layer having top and bottom opposed surfaces;

b. a transparent release layer comprising predetermined printed portions applied to said bottom surface of said upper layer;

c. a pigmented, adhesive layer applied to the bottom surface of said upper layer over the release layer, the adhesive layer having a relatively strong adhesive bond to the upper layer in areas between the printed portions, and a relatively weak adhesive bond to the printed portions; and, d. a lower layer of flexible material removably laminated to the upper layer by the adhesive layer;

e. wherein a separation of the upper layer from said adhesive layer causes a first portion of said adhesive layer located between the printed portions to define a border around said printed portions thereby making said printed portions visually distinguishable from said upper layer and thus providing an indication of separation.

17. A continuous series of detachable identification bracelets as recited in claim 18, wherein die cuts are provided between each of said series of bracelets, and said die cuts are of sufficient depth to be sensed by an optical sensing device.

* * * * *